US005519892A

United States Patent [19]

Pizzacar

[11] Patent Number: 5,519,892

[45] Date of Patent: May 28, 1996

[54] ADVERTISING CAP NAMEPLATE

[76] Inventor: Anthony Pizzacar, 160 Greenway West, New Hyde Park, N.Y. 11040

[21] Appl. No.: 84,913

[22] Filed: Jul. 1, 1993

[51] Int. Cl.[6] ..... A42B 1/24

[52] U.S. Cl. ..... 2/195.2; 2/181; 2/181.4; 2/209.13; 40/329

[58] Field of Search ..... 2/162, 170, 181, 2/181.2, 181.4, 183, 195.1, 195.2, 195.4, 209.13, 209.14, 910, 917, DIG. 11; 40/310, 316, 586, 630, 633, 329

[56] References Cited

U.S. PATENT DOCUMENTS

| | | | |
|---|---|---|---|
| Re. 33,430 | 11/1990 | Nunnery et al. | 2/181 |
| 5,003,640 | 4/1991 | Pizzacar | 2/195.2 |
| 5,287,559 | 2/1994 | Christiansen et al. | 2/209.13 |
| 5,315,714 | 5/1994 | Peters et al. | 2/195.4 |
| 5,428,844 | 7/1995 | Dougherty | 2/181.4 |

*Primary Examiner*—Diana Biefeld
*Attorney, Agent, or Firm*—Michael I. Kroll

[57] ABSTRACT

An improved advertising nameplate is provided for a cap to be worn on a head of a person. The cap has a crown with a headband and a pair of adjustment straps at the back of the crown to adjust the size of the headband. The nameplate consists of a structure for concealing the pair of adjustment straps after the headband on the crown is adjusted. An apparatus is for removably mounting the concealing structure to the pair of adjustment straps, so that the concealing structure may be changed depending upon the preference of the person. A logo for advertising is disposed directly onto the concealing structure, so that the logo may be displayed therefrom.

2 Claims, 2 Drawing Sheets

(SNAPS)

(ADHESIVE)

(BUTTONS)

ADVERTISING CAP NAMEPLATE

BACKGROUND OF THE INVENTION

1. Field of the Invention

The instant invention relates generally to headgear and more specifically it relates to an improved advertising cap nameplate.

2. Description of the Prior Art

Numerous headgear have been provided in prior art that are adapted to include logos thereon being names, symbols or trademarks of companies or publications. While these units may be suitable for the particular purpose to which they address, they would not be as suitable for the purposes of the present invention as heretofore described.

SUMMARY OF THE INVENTION

A primary object of the present invention is to provide an improved advertising cap nameplate that will overcome the shortcomings of the prior art devices.

Another object is to provide an improved advertising cap nameplate which will cover and conceal the adjustment straps of a cap and display a logo therefrom.

An additional object is to provide an improved advertising cap nameplate that can be conveniently mounted about and removed from the adjustment straps of the cap.

A further object is to provide an improved advertising cap nameplate that is simple and easy to use.

A still further object is to provide an improved advertising cap nameplate that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1A:
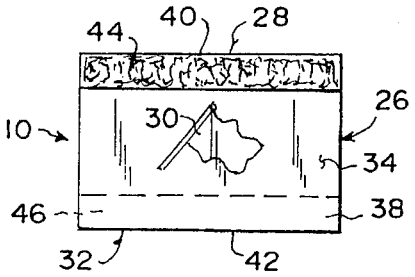
FIG. 1A is an elevational view of a first embodiment of the instant invention with VELCRO (trademark for hook-and-loop pile fastener means) and without slots.
Figure 1:
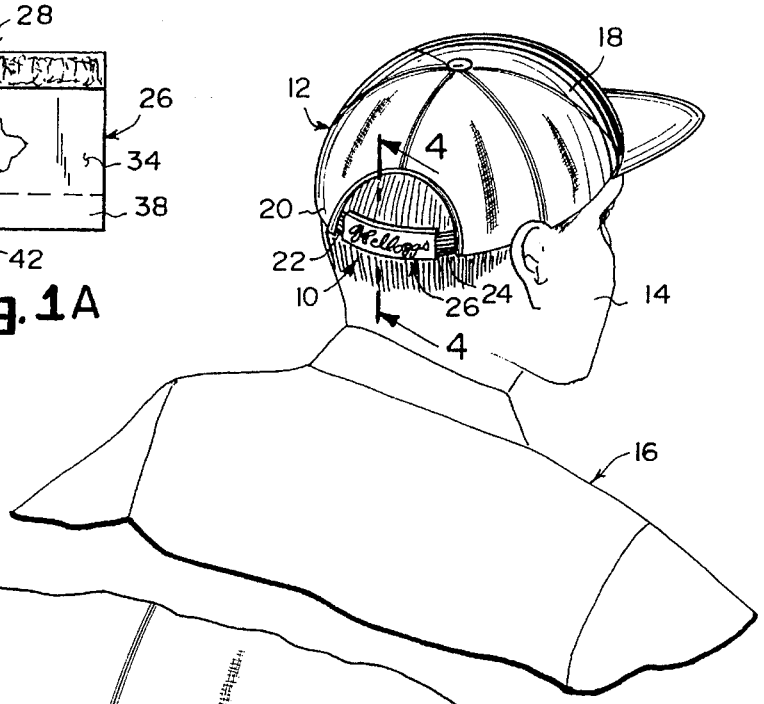
FIG. 1 is a perspective view of a person wearing a cap with the instant invention mounted about the adjustment straps.
Figure 2:
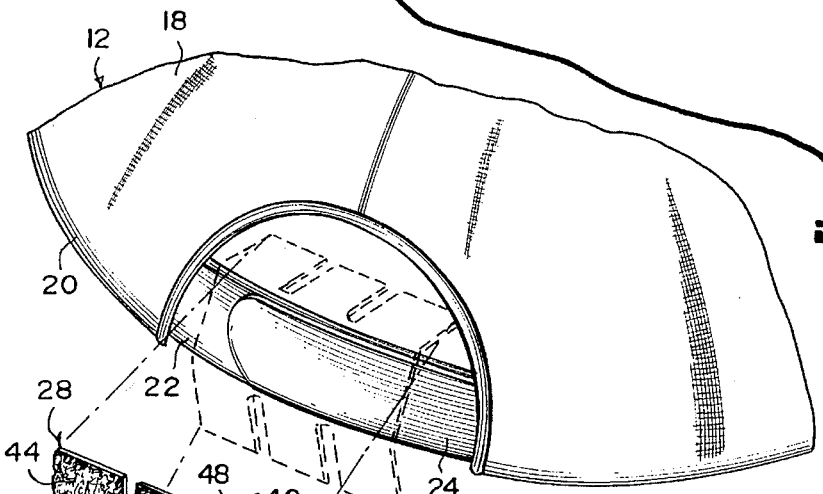
FIG. 2 is an enlarged perspective view of a portion of the cap showing a second embodiment with hook-and-loop pile fastener means and slots ready to be mounted about the adjustment straps.
Figure 2:
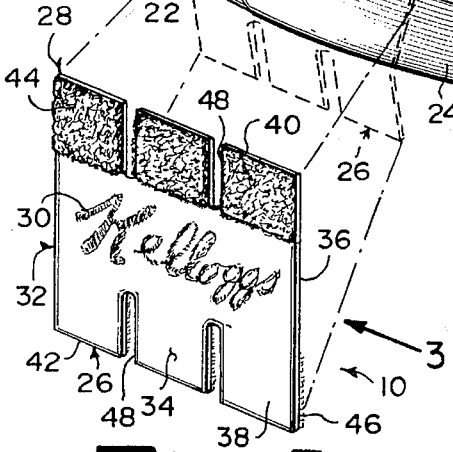
Figure 3:
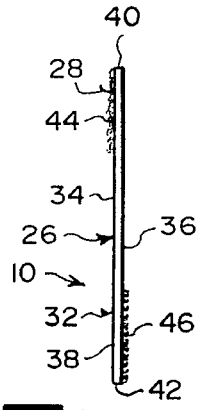
FIG. 3 is an end view taken in direction of arrow 3 in FIG. 2.
Figure 4:
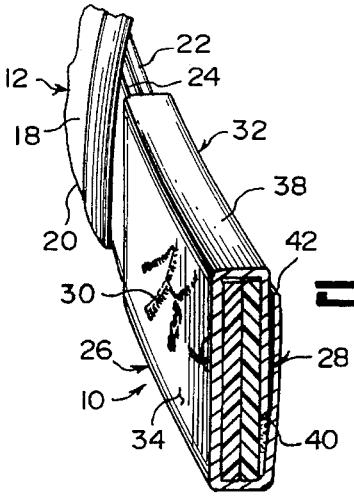
FIG. 4 is a cross sectional perspective view taken along line 4—4 in FIG. 2.

Turning now descriptively to the drawings, in which similar reference characters denote similar elements throughout the several views, FIGS. 1 through 5 illustrate an improved advertising nameplate 10 for a cap 12 to be worn on a head 14 of a person 16. The cap 12 has a crown 18 with a headband 20 and a pair of adjustment straps 22, 24 at the back of the crown 18 to adjust the size of the headband 20. The nameplate 10 consists of a structure 26 for concealing the pair of adjustment straps 22, 24 after the headband 20 on the crown 18 is adjusted. An apparatus is for removably mounting the concealing structure 26 to the pair of adjustment straps 22, 24, so that the concealing structure 26 may be changed depending upon the preference of the person 16. A logo 30 for advertising is disposed directly onto the concealing structure 26, so that the logo 30 may be displayed therefrom.

The concealing structure 26, as shown in FIGS. 1 through 7, is a flexible panel 32 having a front surface 34 for displaying the logo 30 and a blank rear surface 36. The flexible panel 32 is a rectangular shaped piece of cloth 38 in which the long sides 40, 42 of the piece of cloth 38 will fold over and upon each other, when the piece of cloth 38 is placed onto the pair of adjustment straps 22, 24.

The removably mounting apparatus 28, as best seen in FIGS. 1A, 2, 3 and 4, is a hook and loop pile fastener in which a first portion 44 is affixed to the front surface 34 along the top long side 40, while a second portion 46 is affixed to the rear surface 36 along the bottom long side 42. When the piece of cloth 38 is folded over the first portion 44 will mate with the second portion 46.

The piece of cloth 38, as shown in FIGS. 2, 5, 6 and 7, can have a plurality of slots 48 extending inwardly from each of the long sides 40, 42, so as to eliminate buckling when folded over the pair of adjustment straps 22, 24.

Figure 5:
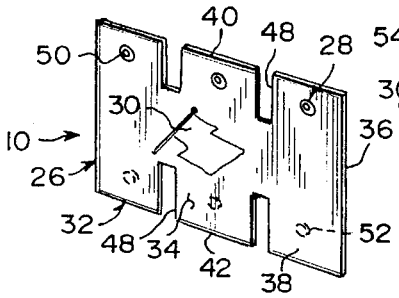
FIG. 5 is a perspective view of a third embodiment of the instant invention with snaps.

The removably mounting apparatus 28, as shown in FIG. 5, is a plurality of snap fasteners in which the socket portions 50 are attached in spaced apart relationships to the front surface 34 along the top long side 40, while the stud portions 52 are attached in spaced apart relationships to the rear surface 36 along the bottom long side 42. When the piece of cloth 38 is folded over the stud portions 52 will engage with the socket portions 50.

Figure 6:
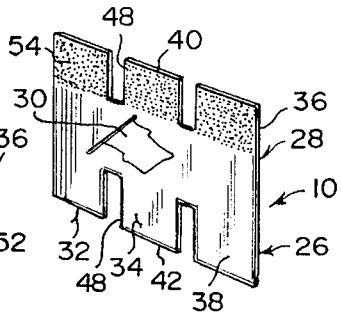
FIG. 6 is a perspective view of a further embodiment of the instant invention with adhesive.

The removably mounting apparatus 28, as shown in FIG. 6, is an adhesive layer fastener 5 applied onto the front surface 34, along the top long side 40. When the piece of cloth 38 is folded over the adhesive layer fastener 54 will stick to the rear surface 36 along the bottom long side 42.

Figure 7:
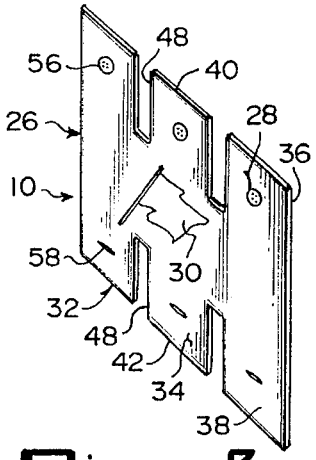
FIG. 7 is a perspective view of a fifth embodiment of the instant invention with buttons.

The removably mounting apparatus 28, as shown in FIG. 7, is a plurality of buttons 56 attached in spaced apart relationships to the front surface 34 along the top long side 40, while a plurality of buttonholes 58 are formed in spaced apart relationships to the bottom long side 42. When the piece of cloth 38 is folded over the buttons 56 can engage with the buttonholes 58.

Figure 8:
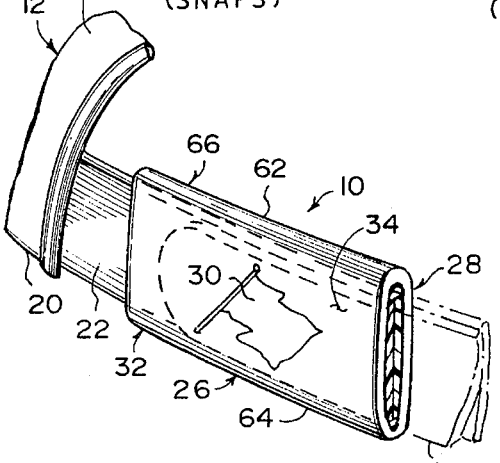
FIG. 8 is a perspective view of a portion of the cap, showing a sixth embodiment of the instant invention being a sleeve installed onto the adjustment straps.

The removably mounting apparatus 28, shown in FIG. 8, is a second flexible panel 60 integrally attached along its top long side 62 and its bottom long side 64 with the first flexible panel 32, so as to form a sleeve 66 installed onto the adjustment straps 22, 24.

Figure 9:
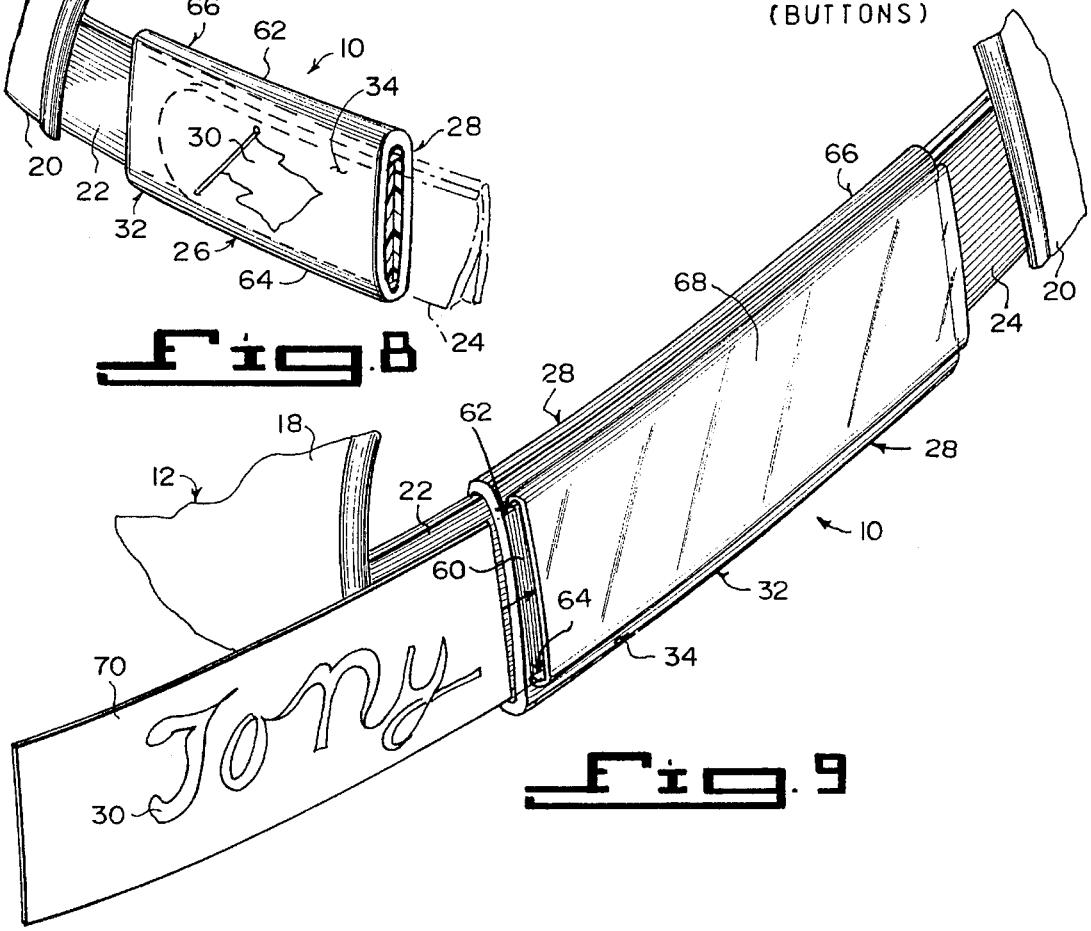
FIG. 9 is a perspective view of a portion of the cap showing a seventh embodiment of the instant invention being a sleeve with a transparent pocket receiving a logo plate installed onto the adjustment straps.

A transparent pocket 68 can be affixed to the front surface 34 of the first panel 32 of the sleeve 66, as shown in FIG. 9. An elongated plate 70 having the logo 30 thereupon is provided. The plate 70 can be inserted and removed from the transparent pocket.

OPERATION OF THE INVENTION

To use the improved advertising nameplate 10 shown in FIGS. 1 through 7, the person 16 first adjusts the headband 20 with adjustment straps 22 and 24. The piece of cloth 38 can be folded over the adjustment straps 22 and 24 and secured by the removably mounting apparatus 28. The logo 30 will now be visible behind the crown 18 after the cap 12 is placed upon the head 14 of the person. The improved advertising nameplate 10 in FIGS. 8 and 9 are used in the following manner. The sleeve 66 is placed onto the adjustment strap 22 first. The other adjustment strap 24 is then inserted into the sleeve 66 and adjusted thereto. In FIG. 9, the plate 70 with the logo 30 can then be inserted and removed from the transparent pocket 68 when so desired.

LIST OF REFERENCE NUMBERS

10 improved advertising nameplate
12 cap
14 head
16 person
18 crown
20 headband
22 adjustment strap
24 adjustment strap
26 concealing structure
28 removably mounting apparatus
30 logo
32 flexible panel for 26
34 front surface of 32
36 blank rear surface of 32
38 rectangular shaped piece of cloth for 32
40 top long side of 38
42 bottom long side of 38
44 first portion of a hook and loop pile fastener
46 second portion of a hook and loop pile fastener
48 slot in 38
50 socket portion of a snap fastener
52 stud portion of a snap fastener
54 adhesive layer fastener
56 button
58 buttonhole
60 second flexible panel
62 top long side of 60
64 bottom long side of 60
66 sleeve
68 transparent pocket
70 elongated plate with 30

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An advertising nameplate for a cap to be worn on a head of a person, the cap having a crown with a headband and a pair of adjustment straps at the back of the crown to adjust the size of the headband, said nameplate comprising:

a) means for concealing the pair of adjustment straps after the headband on the crown is adjusted; and, b) means for removably mounting said concealing means to the pair of adjustment straps, so that said concealing means would be changeable depending upon the preference of a person, said means for removably mounting being a hook-and-loop pile fastener, in which a first portion is affixed to a front surface along a top long side, while a second portion is affixed to a rear surface along a bottom long side, so that when a piece of cloth is folded over, said first portion will mate with said second portion, said piece of cloth having a plurality of slots extending inwardly from each of the top long side and the bottom long side, so as to eliminate buckling when folded over the pair of adjustment straps, said concealing means being a flexible panel having a front surface for displaying said logo and a blank rear surface.

2. An advertising nameplate for a cap to be worn on a head of a person, the cap having a crown with a headband and a pair of adjustment straps at the back of the crown to adjust the size of the headband, said nameplate comprising:

a) means for concealing the pair of adjustment straps after the headband on the crown is adjusted; and, b) means for removably mounting said concealing means to the pair of adjustment straps, so that said concealing means would be changeable depending upon the preference of a person, said means for removably mounting being a plurality of snap fasteners, in which socket portions are attached in spaced apart relationships to a front surface along a top long side, while stud portions are attached in spaced apart relationships to a rear surface along a bottom long side, so that when said piece of cloth is folded over, said stud portions will engage said socket portions, said piece of cloth having a plurality of slots extending inwardly from each of the top long side and the bottom long side, so as to eliminate buckling when folded over the pair of adjustment straps, said concealing means is a flexible panel having a front surface for displaying said logo and a blank rear surface.

* * * * *